US005361453A

United States Patent [19]

Gerber

[11] Patent Number: 5,361,453

[45] Date of Patent: Nov. 8, 1994

[54] BRISTLE BED CLEANER FOR SHEET MATERIAL CUTTING MACHINE

[75] Inventor: Heinz J. Gerber, West Hartford, Conn.

[73] Assignee: Gerber Garment Technology, Inc., Tolland, Conn.

[21] Appl. No.: 943,880

[22] Filed: Sep. 11, 1992

[51] Int. Cl.[5] ..... A47L 5/38

[52] U.S. Cl. ..... 15/308; 15/3; 15/142; 15/256.53; 15/309.1; 15/312.1; 15/345

[58] Field of Search ..... 15/88.2, 88.3, 308, 15/309.1, 256.5, 256.53, 345, 346, 312.1

[56] References Cited

U.S. PATENT DOCUMENTS

| | | | |
|---|---|---|---|
| 2,651,080 | 9/1953 | Wied | 15/345 X |
| 3,694,848 | 10/1972 | Alcala | 15/346 |
| 4,205,835 | 6/1980 | Gerber . | |
| 4,224,711 | 9/1980 | Gerber . | |
| 4,328,726 | 5/1982 | Pearl . | |
| 4,345,496 | 8/1982 | Pearl . | |
| 4,452,113 | 6/1984 | Pearl . | |
| 4,463,483 | 8/1984 | Holm | 15/256.53 X |
| 4,572,357 | 2/1986 | Pearl . | |
| 4,730,526 | 3/1988 | Pearl et al. . | |
| 4,951,345 | 8/1990 | Nappi | 15/308 X |
| 5,197,160 | 3/1993 | Smith | 15/345 X |

*Primary Examiner*—Chris K. Moore

*Attorney, Agent, or Firm*—McCormick, Paulding,Huber

[57] ABSTRACT

A cleaner for cleaning debris from the bristles of a bristle bed which provides the work material support surface for a sheet material cutting machine performs its cleaning operation while the bristle bed or the bristle units making up the bristle bed remain in place on the cutting machine. A plurality of blades which may be either rotary or non-rotary are fixed to and spaced relative to one another along a given line. During a cleaning operation the blades enter the bristle bed and are moved in a direction perpendicular to the given line and parallel to the support surface to dislodge debris from the bristles. A vacuum device may be included in the cleaner to collect the dislodged debris and the cleaner may also include a vibrator for vibrating either the blades or the bed in the vicinity of the blades to assist in freeing the debris from the bristles.

48 Claims, 13 Drawing Sheets

BRISTLE BED CLEANER FOR SHEET MATERIAL CUTTING MACHINE

CROSS REFERENCE TO RELATED APPLICATION

This application relates to copending U.S. patent application Ser. No. 08/132,388 entitled CLOTH CUTTER BED SLAT CLEANER WITH VACUUM REMOVAL FEATURE, filed in the name of Kuchta on Oct. 6, 1993.

FIELD OF THE INVENTION

This invention relates to an apparatus for periodically cleaning the work material supporting bristle bed of a sheet material cutting machine to remove loose fibers, threads, small pieces of work material and other debris which tends to collect in the spaces between the bristles of the bed during use of the cutting machine, which debris if unremoved may hinder efficient operation of the cutting tool which penetrates into the bed during the cutting operation or may impede air flow through the bed in the event a vacuum is applied to the bed during cutting to aid in holding or compressing the work material and/or in the event pressurized air is applied to the bed during loading or unloading of work material to or from the bed to facilitate sliding of the work material over the support surface provided by the bed; and deals more particularly with such a cleaner capable of cleaning the bristle bed while the bed, or the individual bristle units making up the bed, remain in place on the cutting machine.

BACKGROUND OF THE INVENTION

The apparatus of this invention is one for cleaning debris from the work supporting bed of a sheet material cutting machine wherein such bed is comprised of a plurality of generally vertically extending bristles the free ends of which define the work material supporting surface, so that the bed may be penetrated by a reciprocating knife or similar cutting tool used to cut the sheet material and so that air may pass through the bed either downwardly relative to the upper free ends of the bristles to create a vacuum pressure at the support surface or upwardly relative to the upper free ends of the bristles to create a positive pressure adjacent the support surface. A typical bristle bed of the type with which the cleaner of this invention may be used is shown by U.S. Pat. No. 4,205,835 in which case the bristle bed is comprised of a number of bristle units or squares made of injection molded plastic with each unit having a lower base and a plurality of densely spaced bristles extending vertically upwardly from the base.

It is known that in the use of cutting machines having bristle beds such as shown by U.S. Pat. No. 4,205,835 cutting debris tends to collect between the bristles of the bed and should be periodically removed to maintain efficient performance of the machine. Apparatus for cleaning bristle beds of the above described kind are already known wherein individual bristle units or groups of bristle units are cleaned by applying sharp impact forces to the bristle units to shake the accumulated debris from the bristles. One such apparatus is shown by U.S. Pat. No. 4,224,711. This type of cleaner, however, has the disadvantage that to achieve cleaning of the bristle bed the bristle units making up the bed have to be individually separated from the bed and cutting machine, cleaned by the cleaning apparatus remote from the machine, and then reassembled with the machine after having been cleaned; and this requires a great amount of time and labor.

The general object of this invention is therefore to provide a cleaner capable of cleaning the bristle bed of a cutting machine while the bristle bed, or the bristle units making up such bed, remain in place on the cutting machine, thereby avoiding the need for disassembling the bed from the machine for the cleaning operation.

A further object of the invention is to provide a bristle bed cleaner of the aforementioned character which can be made as a relatively small, lightweight and inexpensive unit.

A still further object of the invention is to provide a bristle bed cleaner of the above character which can perform its cleaning operation essentially automatically without significant human attention and which can, if desired, be used to clean a bristle bed during the night or other times when the cutting machine is normally out of use, or can be used during normal cutting operations.

Further objects and advantages of the invention will be apparent from the following detailed description of preferred embodiments of the invention and from the accompanying drawings and claims.

SUMMARY OF THE INVENTION

The invention resides in a bristle bed cleaner comprised of a plurality of blades fixed to and spaced from one another along a given line, which blades are moved through the bristle bed in a direction perpendicular to the given line and parallel to the support surface of the bed so that the blades pass between the bristles of the bed and dislodge accumulated debris therefrom.

The invention also resides in the plurality of blades being either non-rotatable about the given line so that during a cleaning operation they remain constantly in the bed or being rotatable about the given line so that during operation the blades move into and out of the bed and exert an additional lifting influence on the debris.

The invention also resides in the line along which the blades are located being of a length a number of time smaller than the width of the support surface of the bristle bed and in the cleaner either being permanently mounted to the cutting head carriage of the cutting machine along with the cutter head or being mountable to the cutting head carriage in substitution for the cutter head so that movement between the cleaner and the bristle bed may be obtained by movement of the cutter head carriage relative to the bristle bed, the entire bristle bed being cleaned by the cleaner making several passes along one coordinate direction of the bristle bed with the cleaner being indexed in the other coordinate direction at the end of each pass so as to encounter a fresh portion of the bristle bed during the next pass. As an alternative to this, the invention also resides in the line along which the blades are located having a length substantially equal to the entire width of the bristle bed so that the entire bristle bed may be cleaned during one sweep of the cleaner along the length of the bed.

The invention still further resides in the cleaner including a vacuum pickup device having a mouth located adjacent the blades for attracting and receiving debris dislodged by the blades.

The invention also resides in the cleaner including a vibrating means for either engaging and vibrating the bristle bed in the vicinity of the blades or for vibrating the blades relative to the cutting machine frame to assist in dislodging debris from the bristles and to assist the blades in passing between the bristles.

In the case where the line along which the blades are located is a number of times smaller than then width of the bristle bed the invention also resides in the cleaner being rotatable about an axis perpendicular to the support surface of the bed to cause the given line to be oriented either parallel to the length dimension of the support surface, parallel to the width dimension of the support surface, or at some acute angle to the length or width dimension. When the cleaner is oriented with the given line parallel to the length dimension of the support surface it is moved during a cleaning operation in successive passes extending parallel to the width dimension of the support surface, and when the given line is oriented parallel to the width dimension of the support surface the cleaner is moved during a cleaning operation in successive passes extending parallel to the length dimension of the support surface. When the given line is oriented at some acute angle to the length or width dimension the cleaner is moved diagonally of the support surface during a cleaning operation. That is, in each case the given line is moved relative to the bed along a line perpendicular to the given line and parallel to the support surface.

The invention also resides in the cleaner being carried by a cleaner carriage separate from the carriages of the cutting machine associated with the cutter head, and further resides in the cleaner carriage and the cleaner being removable from the cutting machine and being usable, if desired, with another cutting machine after such removal.

The invention still further resides in more specific details of the cleaner and of its assembly and cooperation with parts of the cutting machine as defined in the appended claims.

DESCRIPTION OF THE PREFERRED EMBODIMENTS

Figure 1:
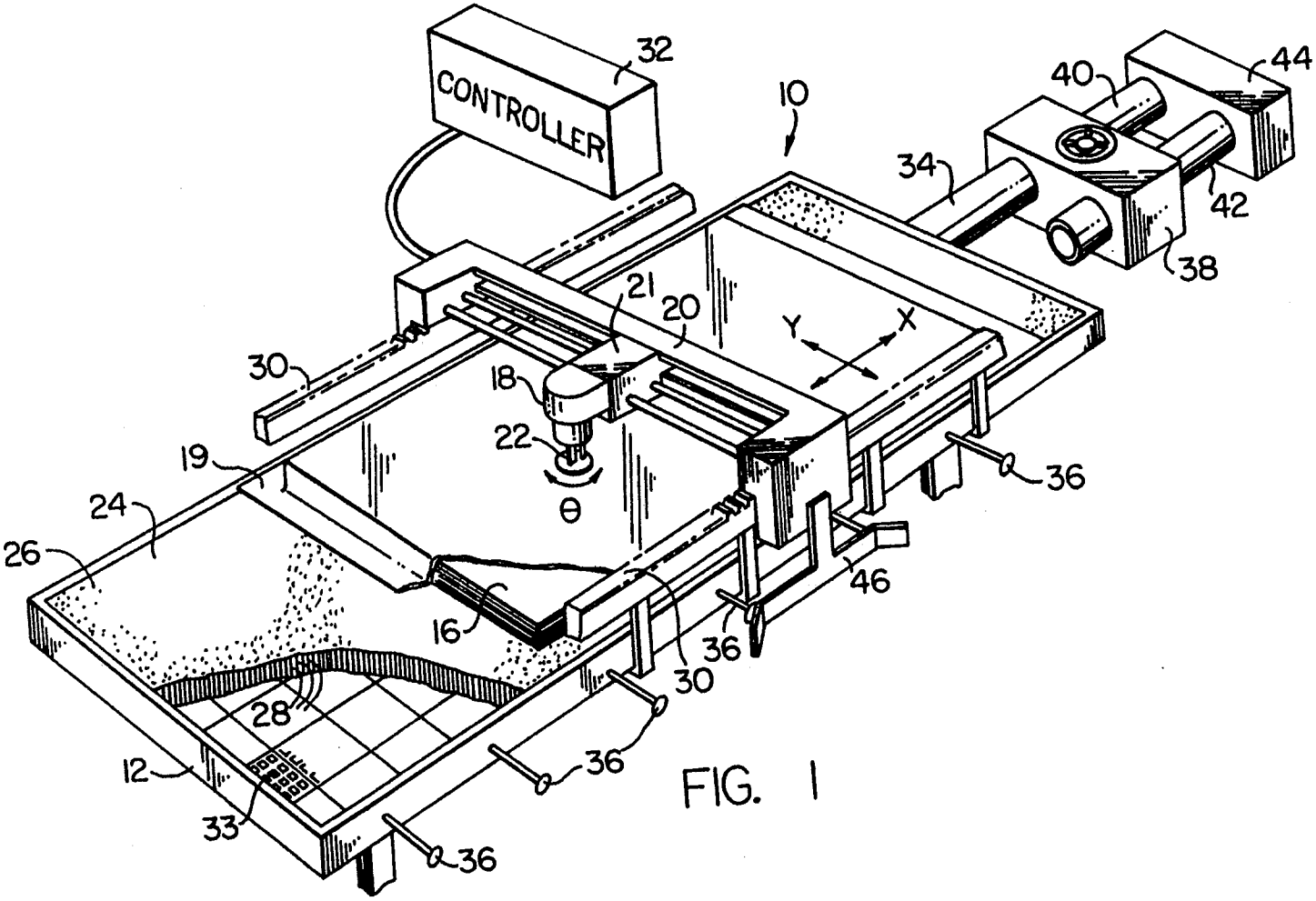
FIG. 1 is a perspective, somewhat schematic, view of a cutting machine of a type with which a cleaner of the invention may be used.

The bristle bed cleaner of this invention may be used with a wide variety of bristle beds including stationary beds and conveyor beds. By way of example FIG. 1 shows one type of cutting machine and bristle bed with which the cleaner of the invention may be used. This illustrated bed is similar to the one of U.S. Pat. No. 4,205,835 to which reference may be made for further details. For the present it is sufficient to note that the cutting machine 10 of FIG. 1 is one intended for the cutting of sheet material which in the present case is shown to be a lay-up 16 of sheets of fabric or like material covered by a sheet of air impermeable material 19 and supported on a table 12. A cutter head 18, having a vertically reciprocating knife 22, is mounted on a cutter carriage 21 which moves along the length of a main carriage 20.

The table 12 of FIG. 1 provides an upwardly facing work material support surface 24 provided by a bristle bed 26. The bristle bed is stationary relative to ground and is comprised of a large number of generally vertically extending bristles 28 the upper free ends of which define the support surface 24. The support surface 24 of the bed is rectangular in shape having a width dimension parallel to the illustrated Y coordinate direction and a length dimension parallel to the illustrated X coordinate direction. The main carriage 20 extends above and across the support surface 24 parallel to the width dimension of the support surface and is movable along the length of the support surface, it being supported at both of its ends by rails 30 with the rails having suitable racks and guide surfaces for supporting the main carriage for movement therealong under the influence of an X drive motor powering pinions which engage the racks on the rails. The cutter head carriage 21 is moved in the Y coordinate direction along the length of the main carriage by a Y drive motor so that by coordinated movements of the main carriage 20 in the X coordinate direction and of the cutter head carriage 21 in the Y coordinate direction the cutter head 18 may be moved along any desired line of cut relative to the work material 16. This movement of the carriages 20 and 21 and related operations of the cutter head 18 are controlled in conventional manner by a main controller 32.

As described in U.S. Pat. No. 4,205,835, the bristle bed 26 is preferably comprised of a plurality of smaller bristle units or squares, which may be made of injection molded plastic, each of which has a base portion and a variety of the bristles 28 extending upwardly therefrom. These bristle units rest on a grid 33 below which are a number of vacuum chambers each extending across the width of the bristle bed and arranged successively along the length of the table with each such vacuum chamber being connectable or disconnectable from a main air duct 34 through the operation of an associated valve operating member 36.

The main air duct 34 is connectable, through a selector valve assembly 38 to either the vacuum port 40 or the pressure port 42 of an air pump or turbine 44. When the air duct 34 is connected to the vacuum port 40 of the air pump each vacuum chamber can be connected to vacuum pressure by pushing its associated operating member 36 inwardly. As shown in FIG. 1 the illustrated device has a cam 46 carried by the main carriage 20 which operates the operating members 36 so that vacuum pressure is applied to the vacuum chambers located beneath or close to the cutting head 18 so as to compress and hold down the work material primarily in the vicinity of the cutter head. When the air duct 34 is connected to the pressurized air port 42 of the air pump 44 by pushing inwardly on appropriate ones of the operating members 36 pressurized air may be applied to the bristle bed to form an air cushion between the support surface 24 and the work material to aid in sliding the work material onto and off of the support surface.

Figure 2:
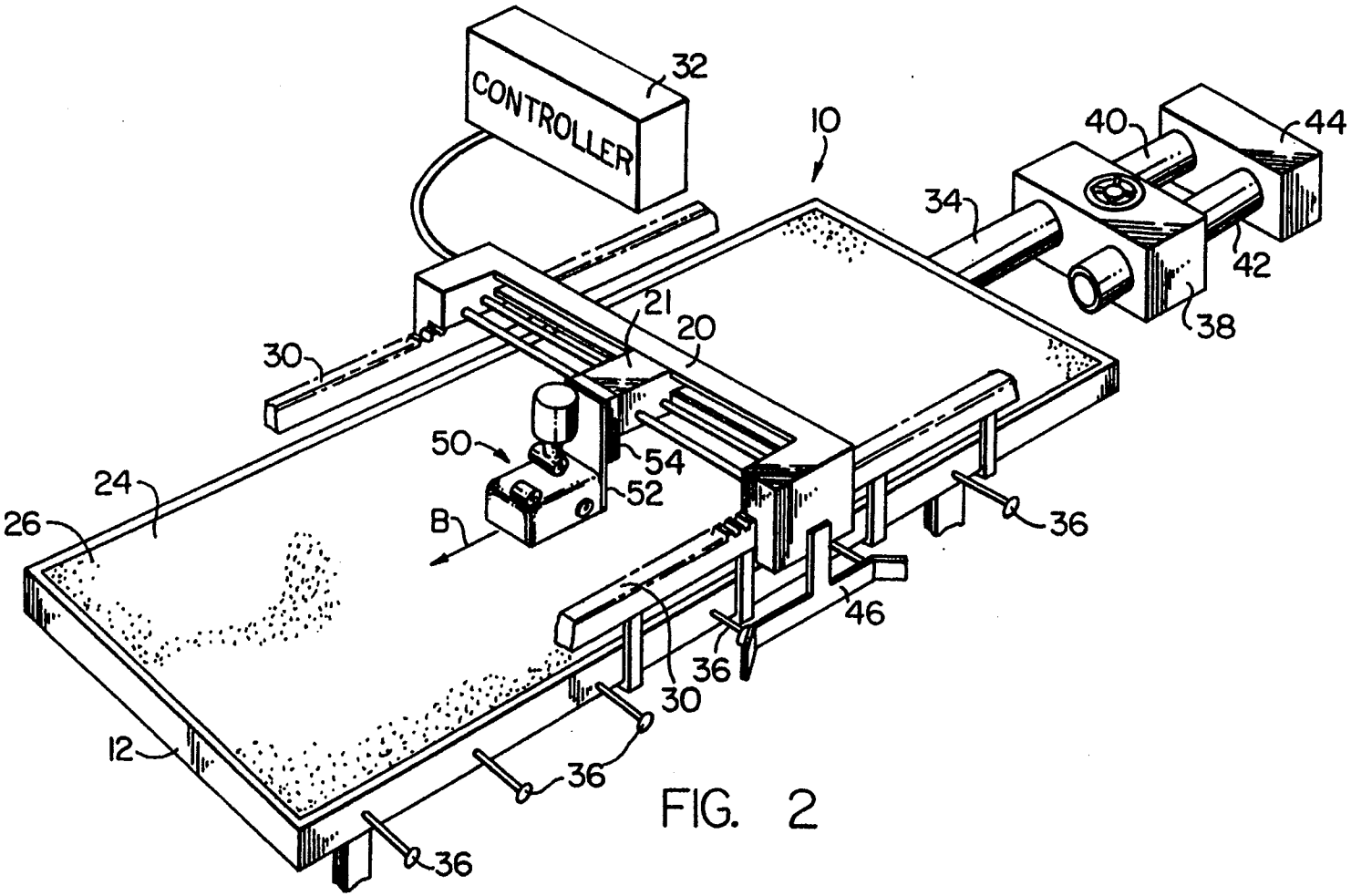
FIG. 2 is a view similar to FIG. 1 but with the cutting head having been removed from the machine and replaced by a cleaner embodying the invention.

In one form of the invention the bristle bed cleaner may be a unit adapted to be attached to the cutter head carriage of the cutting machine either alongside of the cutting head or in substitution for the cutting head. In keeping with this FIG. 2 shows the cutting machine 10 of FIG. 1 with the cutting head 18 of FIG. 1 having been removed and replaced by a cleaner 50 embodying the invention. Therefore, under the direction of the controller 32 the cleaner 50 may be moved along the length of the support surface 24 by movement of the main carriage 30 along the length of the support surface and may be moved parallel to the width dimension of the support surface 24 by moving the cutter head carriage 21 along the length of the main carriage 20. As will be more evident from the description which follows, the cleaner 50 during a cleaning operation is moved along the length of the support surface 24 in the direction of the arrow B and in doing so cleans a swatch of the bristle bed 26 having a width a number of times smaller than the width of the entire bed. Therefore, to clean the entire bed the cleaner is moved so as to execute a number of lengthwise extending passes with the cleaner at the end of each such passes being indexed parallel to the width of the support surface so as to engage and clean a fresh section of the bed during the next pass.

A cleaner embodying the invention has a plurality of blades fixed to and spaced relative from one another along a given line which blades during movement of the blades and the bed relative to one another along a line perpendicular to the given line and parallel to the support surface enter the bed and move between the bristles to dislodge debris from them. These blades may be either rotatable or non-rotatable about the given line and the cleaner may also include or not include a vacuum device for picking up and collecting the dislodged debris and may also include or not include a vibrating means for vibrating either the blades or the bristle bed in the vicinity of the blades. By way of example, the cleaner 50 of FIG. 2, as shown in more detail in FIGS. 3, 4 and 5, is one having non-rotatable blades, a vacuum pickup device for collecting the dislodged debris and a vibrator for vibrating the bristle bed in the vicinity of the blades.

Figure 3B:
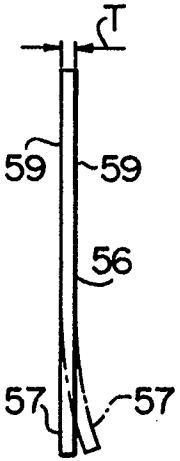
FIG. 3B is a front view of the cleaner blade of FIG. 3A.
Figure 3A:
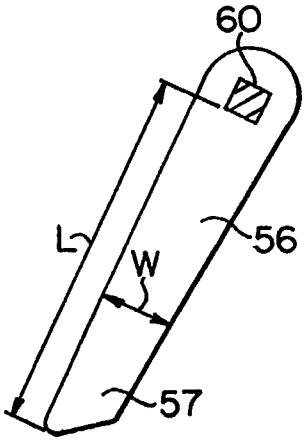
FIG. 3A is an enlarged side view of one of the cleaner blades of FIG. 3.
Figure 3:
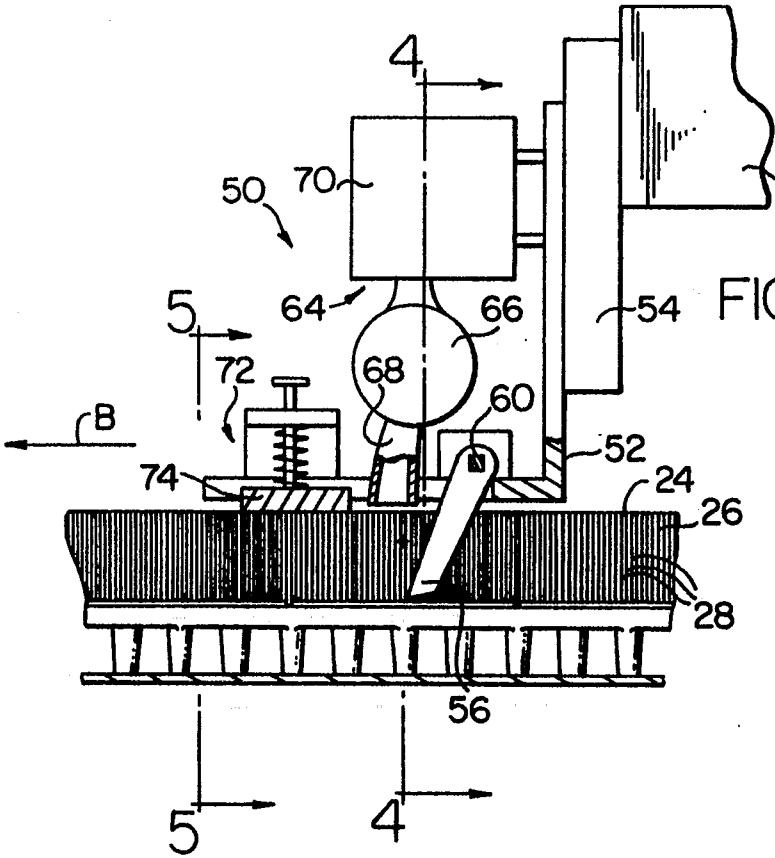
FIG. 3 is a side view, partly in elevation and partly in section, of the cleaner of FIG. 2.
Figure 4:
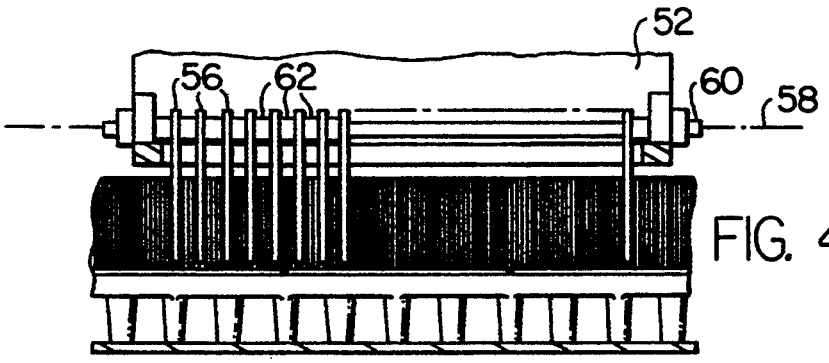
FIG. 4 is a fragmentary view taken on the line 4—4 of FIG. 3.
Figure 5:
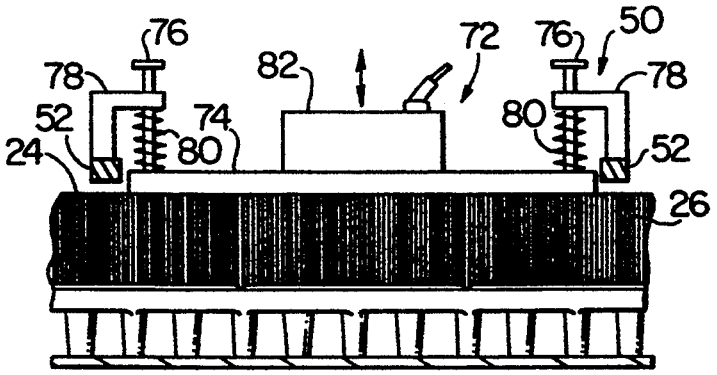
FIG. 5 is a fragmentary view taken on the line 5—5 of FIG. 3.

Referring the FIGS. 3, 4 and 5 the cleaner 50 of FIG. 2 is attached to the cutter head carriage 21 and includes a base frame 52. Between the cutter head carriage 21 and the base plate 52 is an intermediate frame 54. The base frame 52 is vertically movable on the intermediate frame 54 and between the frame 52 and 54 is a suitable means (not shown) for raising and lowering the frame 52 relative to the underlying bristle bed 26. Preferably, the height of the base frame is infinitely adjustable or adjustable in a large number of small steps so that the depth penetration of the blades 56 of the cleaner into the bristle bed is selectively adjustable. In FIG. 2 the base frame 52 is shown in approximately a lowermost position at which the blades 56 have a maximum penetration into the bristle bed 26. From this position the base frame 52 can be moved upwardly to provide for lesser penetration of the blades and, when desired, to remove the blades entirely from the bristle bed to allow the cleaner to be moved rapidly over the support surface 24 without being in engagement with the support surface 24.

The primary component of the cleaner 50 is a plurality of blades 56, 56 which are located along a given line 58, as seen in FIG. 4, and which are fixed to and spaced from one another along that line. The blades are preferably made by being stamped or otherwise cut from sheet metal and are relatively thin in the direction perpendicular to the line 58 so as to be capable of flexing laterally. As shown in FIGS. 3A and 3B each blade 56 has an outer free end 57 and has a length dimension L as measured between the shaft 60 and the free end 57. It also has a width dimension W measured perpendicular to the length dimension L and a thickness dimension T shown in FIG. B and measured parallel to the given line 58. Along most of its length the width dimension W is many time greater than the thickness T. Therefore, each blade is quite sturdy and resistant to deflection in its plane perpendicular to the given line 58 but at its lower end is relatively easily laterally deflectable out of said plane as shown by the broken lines of FIG. B. This allows the free end of each blade to move laterally as may be required to move past some of the bristles of the bristle bed which it may encounter. As an example, for use with bristles having a length of about 1.5 inches and a diameter of about 0.05 inch, each blade may have a thickness T of between 0.010 to 0.040 inches, have along the major portion of its length a width dimension W of from 0.250 to 0.750 inches and have a length L of from 1.5 to 3.0 inches, with the spacing between the side face 59 of one blade and the adjacent side face of the next adjacent blade being between 0.010 and 0.200 inches.

As shown in FIGS. 3 and 4 the blades 56 are non-rotatably mounted on a shaft 60 and the spacing between the individual blades is obtained by spacers 62 also received on the shaft. The shaft 60 is itself a non-rotatably attached to the base frame 52 so that the blades 56 retain the illustrated positions shown in FIGS. 3 and 4 during a cleaning operation. All of the corners and edges of the blades are slightly rounded or dull so that they contain no sharp features which might dig into or cut the bristles.

As shown in FIG. 3 during a cleaning operation, the cleaner 50 moves to the left in the direction of the arrow B and each blade 56 is shaped and positioned so as to have a forward or advance edge which extends generally upwardly and rearwardly from the bottom end of the blade so as to tend to lift upwardly the debris which it encounters during its movement through the bristle bed. The blade shape and arrangement of FIG. 1 is, however, exemplary only and various different shapes and arrangements of the blades may be used without departing from the invention.

The degree which is dislodged and lifted from the bristle bed by the movement of the blades 56 therethrough may be disposed of in various different ways. If desired, an operator following a cleaning operation can manually sweep such debris away using a broom or vacuum cleaner. Preferably however, the cleaner 50, as shown in FIGS. 3, 4 and 5 includes a vacuum pickup device, similar to a vacuum cleaner, for picking up the dislodged debris. This vacuum device 64 has a power unit 66 for creating a vacuum, a pickup head 68 with a mouth located directly in front of the blades 56 and a debris receiving receptacle 70. Therefore, as debris is dislodged by the blades 56 the flow of air through the mouth of the pickup head 68 attracts and carries with it the debris. At the same time, the vacuum pump 44 and selector valve 38 of FIG. 2 may be operated and set so that air under pressure is supplied to the bristle bed which flows upwardly toward the upper free ends of the bristles and further aids in moving the dislodged debris to the support surface where it can be picked up by the vacuum head 68.

The cleaner 50 also includes a vibrator 72 for applying a vertically directed vibrating force to the bristle bed 26 in the vicinity of the blades 56 to further aid in removing debris from the bristles. As shown in FIGS. 3 and 5 this vibrating means includes a plate 74 having a flat downwardly facing surface for engaging the support surface 24 of the bed. At its opposite ends the plate 74 is supported from the base frame 52 by two guide posts 76 which slide vertically through brackets 78 on the base frame 52 with compression springs 80 being received on the guide posts and located between the plate 74 and the brackets 78. When the base frame 52 is lowered to its cleaning position the vibrator plate 74 first encounters the support surface 24 of the bed before the base plate 52 reaches its final lowered position so that when the base plate is in its final lowered position the vibrator plate 74 is urged downwardly against the surface 24 to some degree by compression of the springs 80. Mounted to the plate 74 is a vibrator 82 which applies a vertically oscillating vibrating force to the plate 74 which is thereupon transmitted to the portion of the bed 26 engaged by the plate 74 causing the bed in the vicinity of the plate 74 to be oscillated slightly vertically and to accordingly apply an additional loosening influence to the debris contained between the bristles of the bristle bed. Instead of vibrating only vertically the vibrator may also be designed to have some component to vibration in the horizontal plane.

Figure 6:
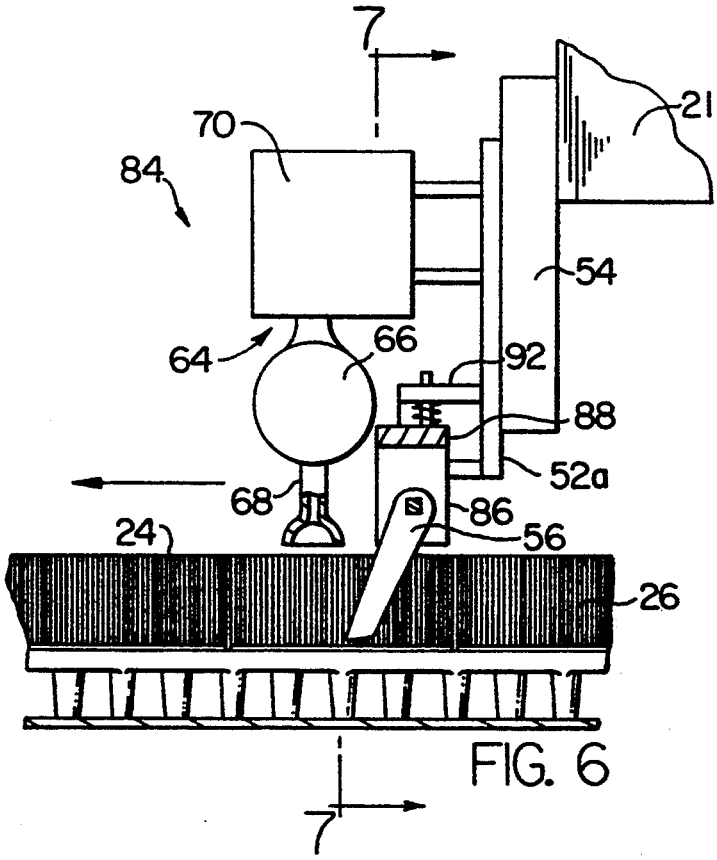
FIG. 6 is a side view similar to FIG. 3 but showing an alternate form of the cleaner.

FIGS. 5 and 6 show another cleaner 84 embodying the invention which may be substituted for the cleaner 50 of FIG. 2. Referring to these figures the cleaner 84 is substantially similar to the cleaner 50 except that the vibrator means instead of being one which applies a vibrating force to the bristle bed 26 is one which applies a vibrating force to the cleaner blades 56.

Figure 7:
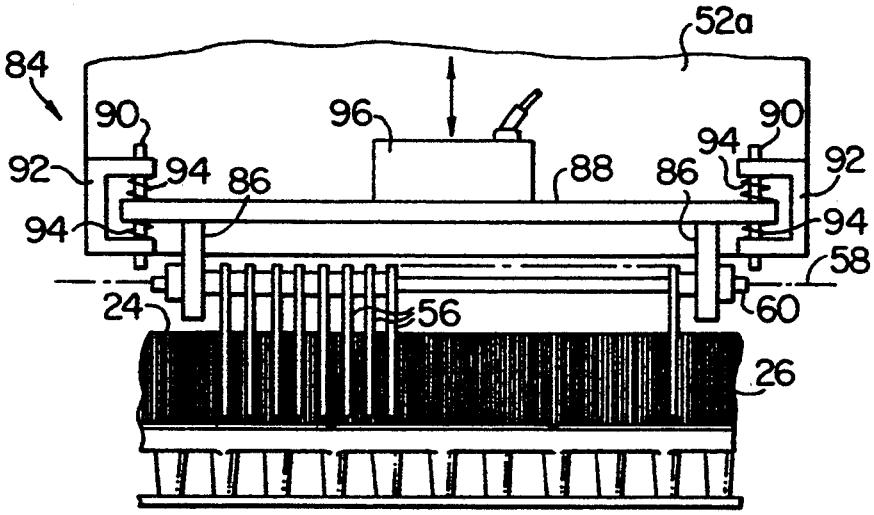
FIG. 7 is a fragmentary view taken on the line 7—7 of FIG. 6.

Turning to FIGS. 6 and 7 in the cleaner 84 the vacuum device 64 and assembly of blades 56 is essentially the same as that of the cleaner 50 and need not be further described. The shaft 60 which carries the blades 56 is supported by two ears on a vibrator plate 88. The plate 88 at its opposite ends carries vertical guide posts 90 passing through brackets 92 of the base frame **52*a* with springs 94 being received on the guide posts and located between the brackets 92 and vibrator plate 88 in the manner shown in FIG. 7. A vibrator 96 is mounted on the plate 88 and applies a vertically directed vibrating force on the plate 88 causing the plate and the attached blades 56 to vibrate in the vertical direction, to assist in loosening debris from the bristles of the bristle bed. If desired the vibrator 96** may also be designed to have some component of vibration in the horizontal plane.

In connection with the vacuum pickup device 64 of the cleaner 50 and of the cleaner 84 it should be noted that if desired the power unit and degree receptacle of such device need not be located on the base frame 52 or **52*a* but instead, if desired, could be located at a place remote from the cutting machine 10 with the vacuum port of the power unit being connected to the pickup head 62 by a flexible hose. Also, the pickup head 68 need not be located in advance of the blades 56** but could also be located at some point behind the blades.

Figure 8:
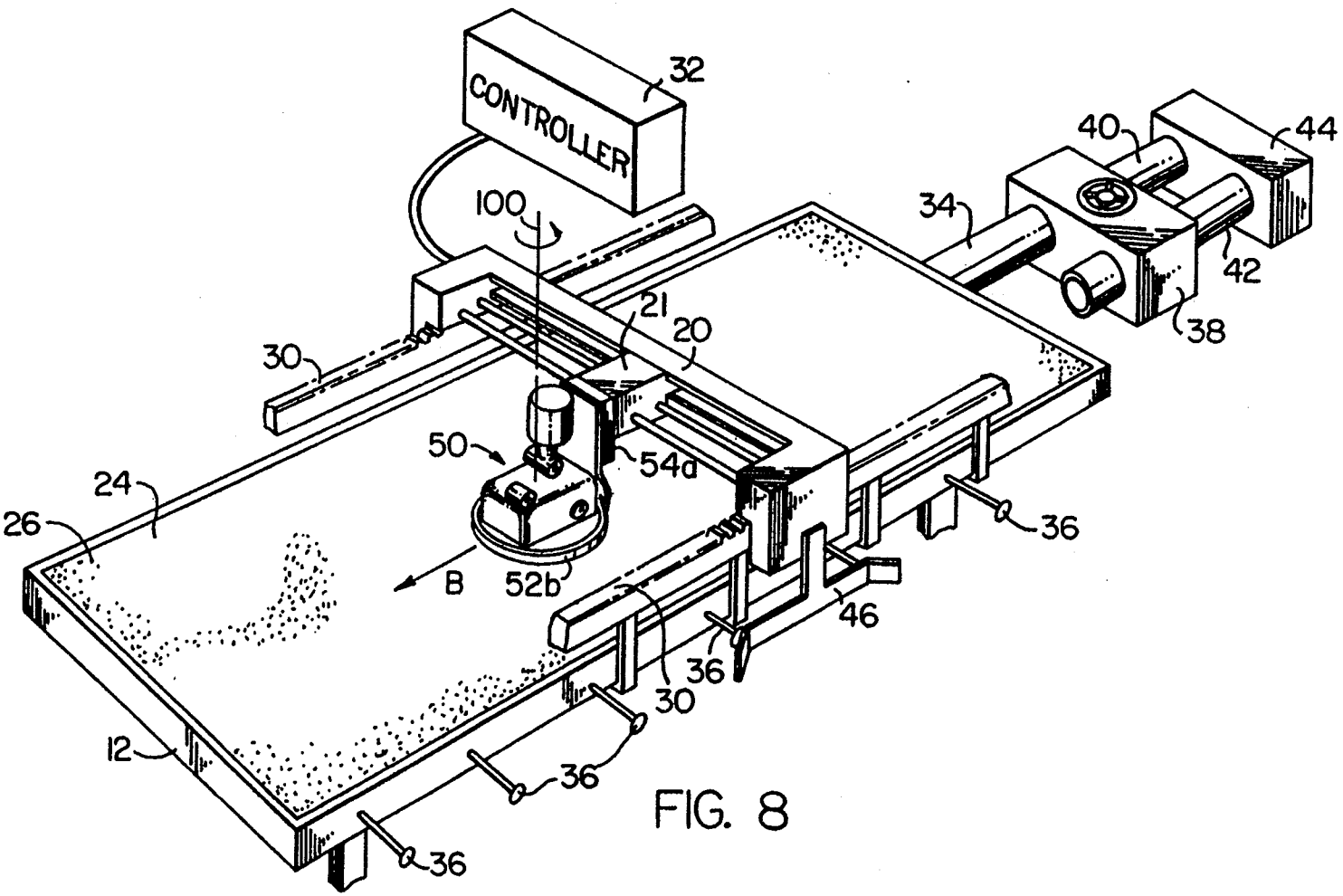
FIG. 8 is a view similar to FIG. 2 but with the cleaner being mounted for rotation about an axis perpendicular to the support surface.

In FIG. 2 the cleaner 50 is shown to be non-rotatably mounted to the cutter head carriage 21 so that during a cleaning operation the cleaner is always moved parallel to the length dimension of the bristle bed 26 as indicated by the arrow B of FIG. 2. A constraint is that the cleaner during a cleaning operation always has to be moved in a direction extending parallel to the support surface 24 and perpendicular to the line 58 along which the cleaning blade 56 are located. However, in some instances it may be desirable to be able to move the cleaner in directions other than lengthwise of the bristle bed. When this is the case the cleaner 50 may be mounted to the cutter head carriage 21 for movement about an axis 100 extending perpendicularly to the support surface 24. In this case the intermediate frame **54*a* is one which supported the base frame 52*b* of the cleaner 50 for rotation about the axis 100 with there being a suitable drive means (not shown) between the intermediate frame 54*a* and the base frame 52*a* for rotating the base frame 52*b* to any desired position about the axis 100 relative to the intermediate frame 54*a*. Therefore, in addition to the cleaner 50 of FIG. 8 being capable of being set to clean while moving in the lengthwise direction of the bristle bed 26, as shown in FIG. 8 it may also be rotated about the axis 100 90° from the illustrated position to allow it to be moved in a direction parallel to the width of the bed during a cleaning operation. Depending on the arrangement of the bristles in the bristle bed it may even be desirable to move the cleaner in successive paths extending diagonally of the bed and this can also be done with the mechanism of FIG. 8 by setting the cleaner to the proper position about the axis 100 which may, for example, be a position displaced 45° from the position shown in FIG. 8**.

Figure 9:
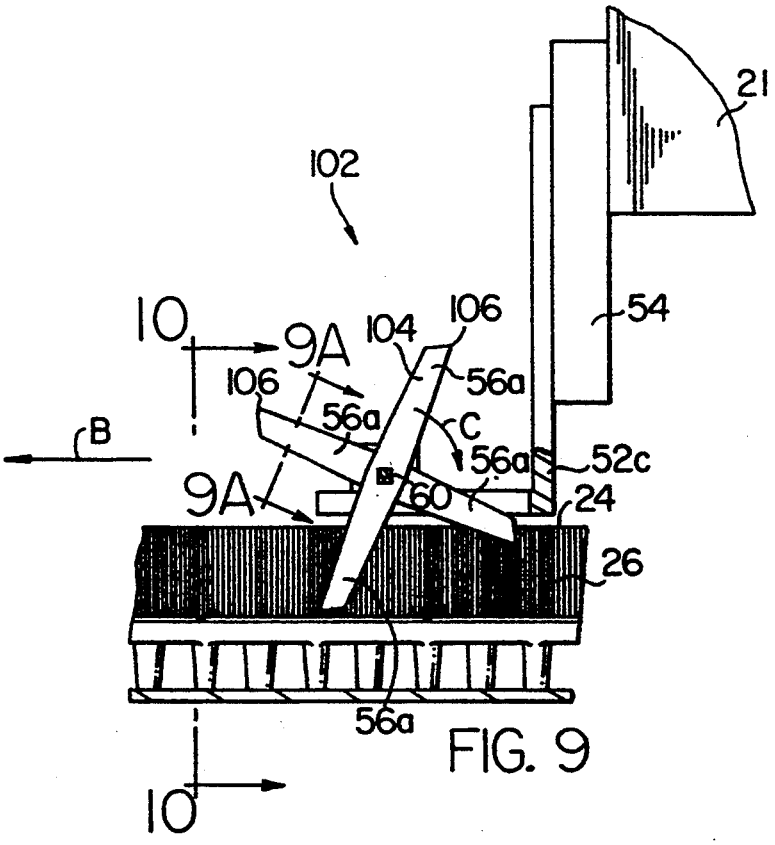
FIG. 9 is a side view generally similar to FIG. 3 but showing an alternate form of cleaner.
Figure 9A:
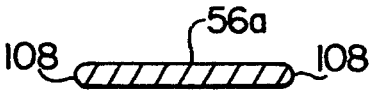
FIG. 9A is a sectional view taken on the line 9A—9A of FIG. 9.
Figure 10:
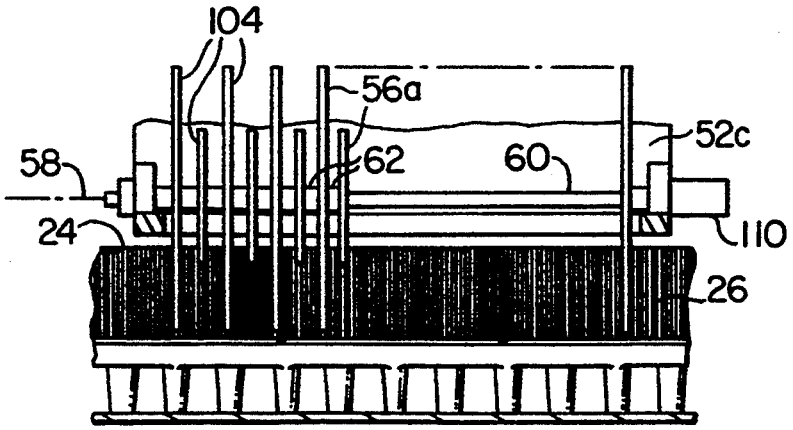
FIG. 10 is a fragmentary view taken on the line 10—10 of FIG. 9.

In the previously described cleaners 50 and 84 the cleaning blades 56 are ones which are non-rotatable relative to the base frame. However, to introduce a still further beneficial cleaning influence, the blades may be made to be ones which are rotated during a cleaning operation. A cleaner 102 having such rotary blades is shown in FIGS. 9, 9A and 10. Turning to these figures, the blades 56*a* are provided by blade members 104 each of which if of elongated shape and non-rotatably received on the shaft 60 at its middle. Each blade member 40 in turn defines two blades 56*a* located 180° from one another about the given line 58 which is coaxial with the shaft 60. The blade members 104 are spaced from one another by the spacers 62 and are preferably rotationally staggered from one another so that no two adjacent blades 56, 56 laterally overlap one another. This has the advantage of providing extra space to allow the bristles to deflect away from the blades as the blades move through the bed. In FIG. 9 the blade members 104 are shown to be rotationally staggered by having successive ones of the members displaced 90° from each other. This particular angular spacing between adjacent blade members is not, however, essential and other different spacings may be used if desired. The blades 56*a* are otherwise similar to the blades 56 of the cleaner 50 and have rounded corners, as shown at 106 in FIG. 9 and rounded edges 108 as shown in FIG. 9A to avoid cutting or digging into the bristle during a cleaning operation.

During cleaning the cleaner 102 is moved in the direction of the arrow B as shown in FIG. 9 and the blades are rotated in the direction of the arrow C with such rotation being effected by a drive motor 110 for the shaft 60 carried by the base frame 52*b*.

For purposes of clarity, the cleaner 102 of FIGS. 9, 9A and 10 has been shown to consist essentially of only the rotating cleaning blades 56*a*. Therefore, the degree which is brought to the support surface 24 by the operation of the cleaner is left there to be picked up by some other means such as a hand-operated vacuum cleaner. However, the cleaner 102 may also have added to it, if desired, a vacuum pickup device, such as the device 64 of the cleaner 50, and may also include either a vibrating means such as the means 72 of the cleaner 50 for vibrating the bristle bed in the vicinity of the blades or a vibrating means such as that illustrated in FIG. 7 for vibrating the blades relative to the bristle bed.

Figure 10A:
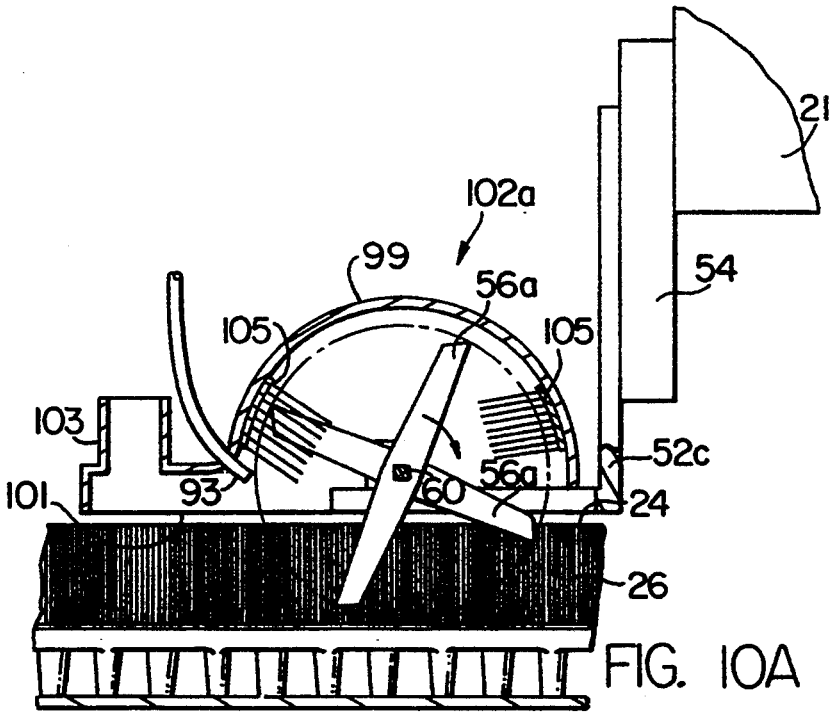
FIG. 10A is a view similar to FIG. 10 but showing a slightly modified form of the cleaner of FIG. 10.

FIG. 10A shows a cleaner 102*a* which is similar to the cleaner 102 of FIGS. 9 and 10 except for including a vacuum hood 99 which has a downwardly open face 101 adjacent the support surface 24 of the bristle bed and which otherwise surrounds and encloses the space containing the rotating cleaner blades 56*a*. An outlet 103 is included in the hood 99 which may be connected to a vacuum source and debris receptacle for removing the debris from the hood. Carried by the hood 99 are two brushes 105 both of which extend parallel to the shaft 60 along the entire line of blades 56*a* and which are arranged so that the blades 56*a* as a result of their rotation by the shaft 60 pass through the bristles of the brushes 105 so that the brushes 105 can strip from the blades any debris which clings to them as they move out of the bristle bed 26. Also carried by the hood 99 are a series of air jet nozzles 93 directed toward the blades 56*a* as they leave the bristle bed to additionally aid in stripping debris from the blades.

Figure 10B:
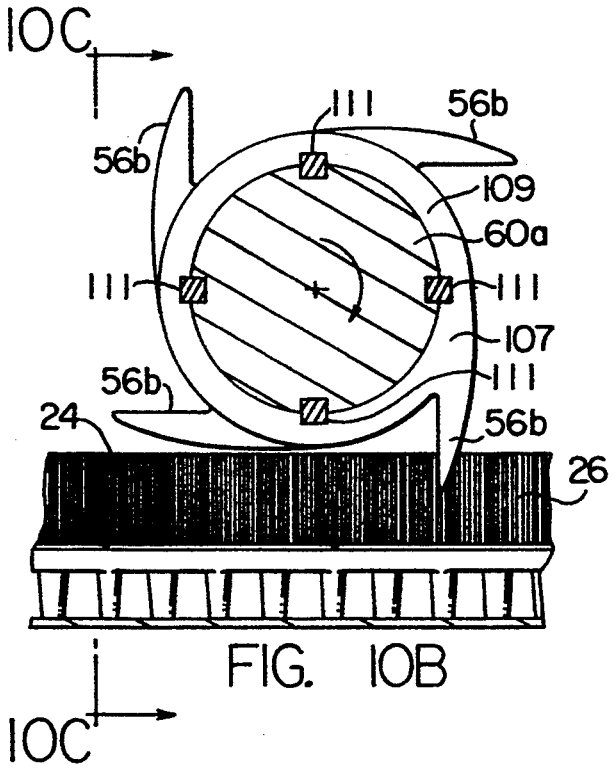
FIG. 10B is a view similar to FIGS. 9 and 10A but showing an alternative form of blade which may be used with the cleaners of FIGS. 9 and 10A.
Figure 10C:
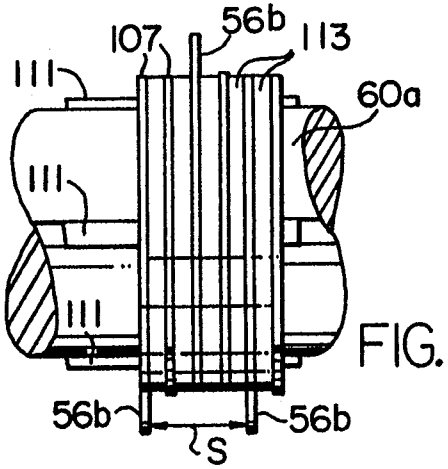
FIG. 10C is a view taken on the line 10C—10C of FIG. 10B showing the spacing arrangement of the blades of FIG. 10B on their supporting shaft.

The shape of the cleaning blades and their manner of mounting to the supporting shaft may vary and by way of example FIGS. 10B and 10C show an alternate form of blade and mounting thereof which may be used in the cleaners of FIGS. 9 and 10A in place of the blades shown in those figures. Referring to FIGS. 10B and 10C each blade 56*b* is provided by a blade member 107 having an angular supporting portion 109 received on the shaft 60*a* and non-rotatably secured thereto by four keys 111. The plurality of blade members 107 are arranged on the shaft 60*a* so that the blades 56*b* are staggered with each being angularly displaced by 90° from its neighbor, and the blade members 107 are spaced from one another along the shaft 60*a* by spacers 113 located therebetween. Therefore, as can be seen from FIG. 10C the space S between two blades 56*b* which have the same angular position on the shaft 60*a* is relatively large and provides space for the bristles of the bristle bed to easily pass therebetween. Also, with the particular shape of the blades as seen in FIG. 3 each blade as it leaves the bristle bed 26 is positioned substantially parallel to the support surface 24 and has a good lifting effect on dislodged debris.

In all of the previously described cleaners the cleaning blades have been located along a line having a length a number of times smaller than the width dimension of the bristle bed. This has the advantage that the cleaner may be made as a relatively small lightweight and inexpensive unit with which the entire extent of the bristle bed may be cleaned by moving the cleaner in a number of passes over the support surface. If desired, however, the cleaner may be constructed so that the line of blades extends across the entire width of the bristle bed thereby allowing the bristle bed to be cleaned in its entirety with a single pass of the cleaner along the length of the bed. Such a cleaner may be essentially similar to any one of the previously described cleaners 50, 84 and 102 except for the longer length of the line of blades. Also, such cleaner need not be indexed parallel to the line of blades (that is, need not be shifted parallel to the width dimension of the bed) and therefore can be attached to the main carriage 20 of the cutting machine 10 rather than to the cutting head carriage 21.

Since the blades 56*a* of the cleaner 102 rotate they may tend to screw the dislodged debris in such as way as to make it difficult for a vacuum pickup device such as shown at 64 in FIG. 1 to pick up all of the dislodged debris; and further some of the debris may tend to remain on the blades 56*a* and be carried back into the bristle bed as the blades reenter the bed.

Figure 12:
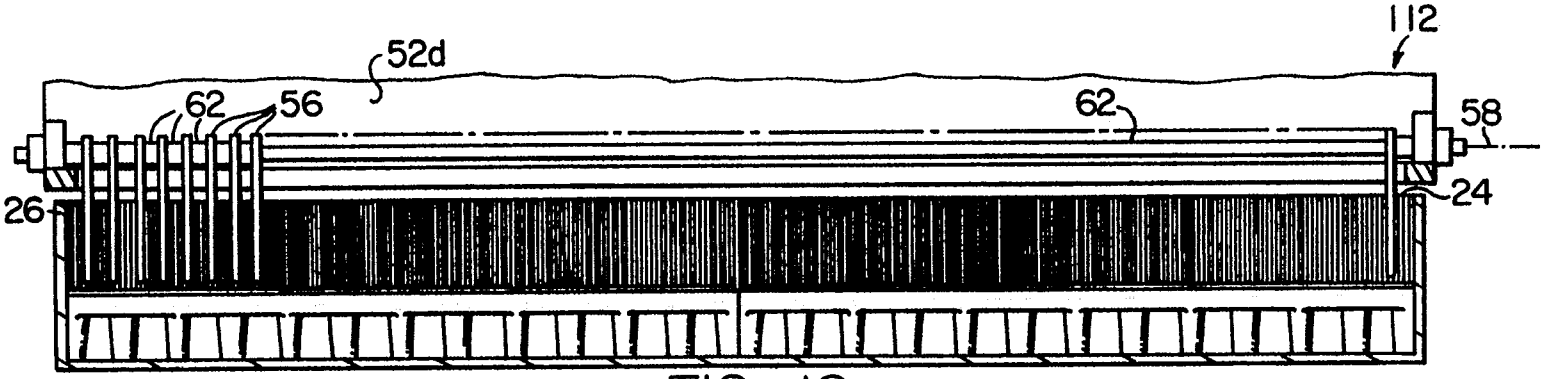
FIG. 12 is a vertical sectional view taken on the line 12—12 of FIG. 11.
Figure 11:
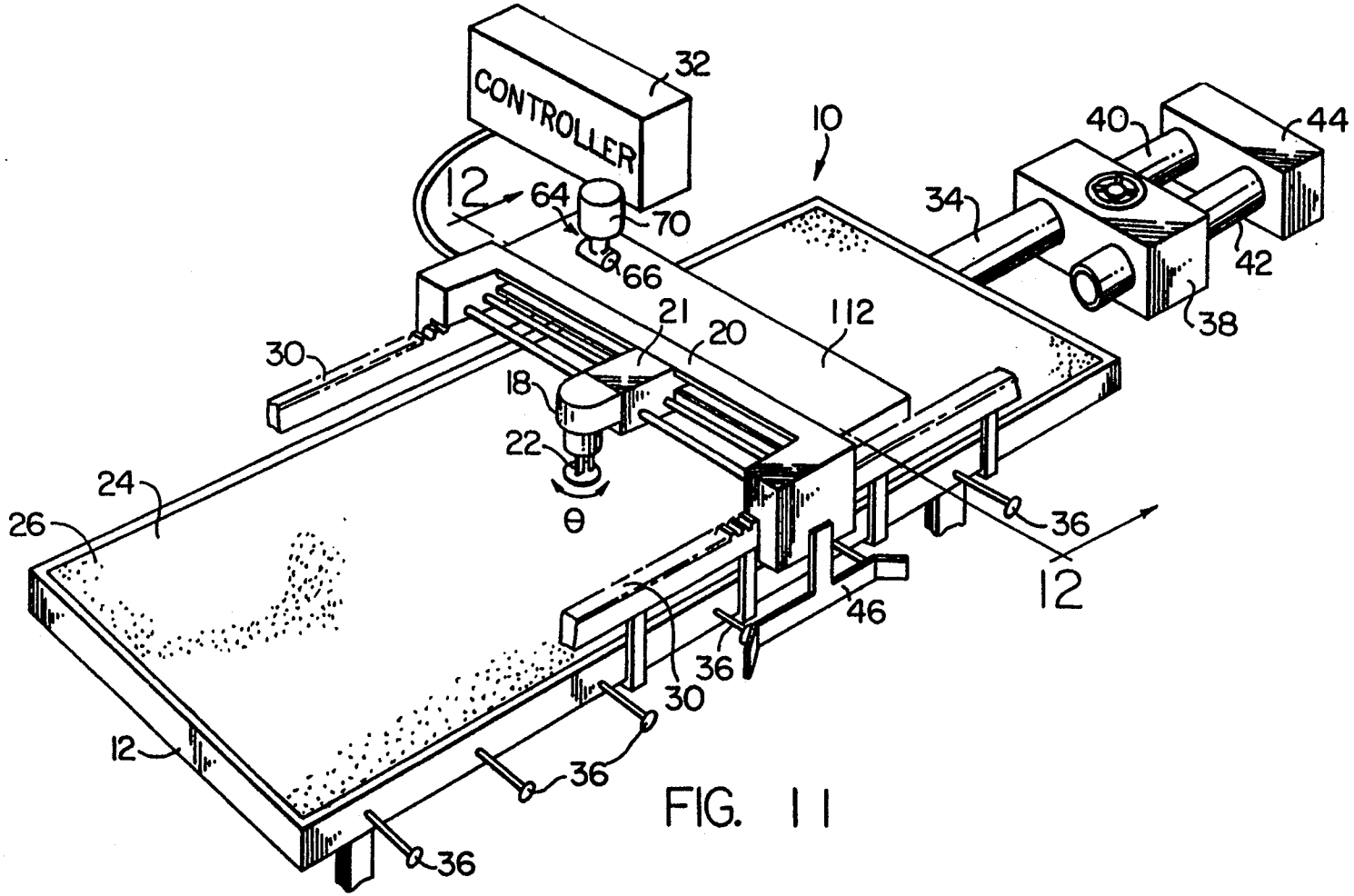
FIG. 11 is a view generally similar to FIG. 2 but showing a cleaner which extends across the full width of the bristle bed.

FIGS. 11 and 12 show such a cleaner at 110. This cleaner 110 is attached to the main carriage 20 and by a suitable means (not shown) is movable vertically to move it into and out of cleaning relationship relative to the bristle bed 26. Otherwise, the cleaner 110 is generally similar to the cleaner 50 of FIGS. 2, 3 and 4 and includes a plurality of blades 56 fixed to and spaced from one another along the given line 58 by being received on the shaft 62 and being separated from one another by spacers 62 also received on the shaft, with the shaft extending across the full width of the bristle bed 26. As shown in FIG. 12 the shaft 62 is held by the base frame 52*b* at its opposite ends and additional supports may be provided for it at other points along its length. The cleaner 110 also includes a vacuum debris pickup device 64 having a power unit 66 and debris receptacle 70 and a pickup head (not shown in FIGS. 11 and 12) similar to that shown at 68 in FIG. 3 which extends across the full width of the bed 26 in advance of the blades 56. A vibrator similar to that shown at 72 in FIG. 3, but extending across the full width of the bed 26 may also be included in the cleaner 110.

Figure 13:
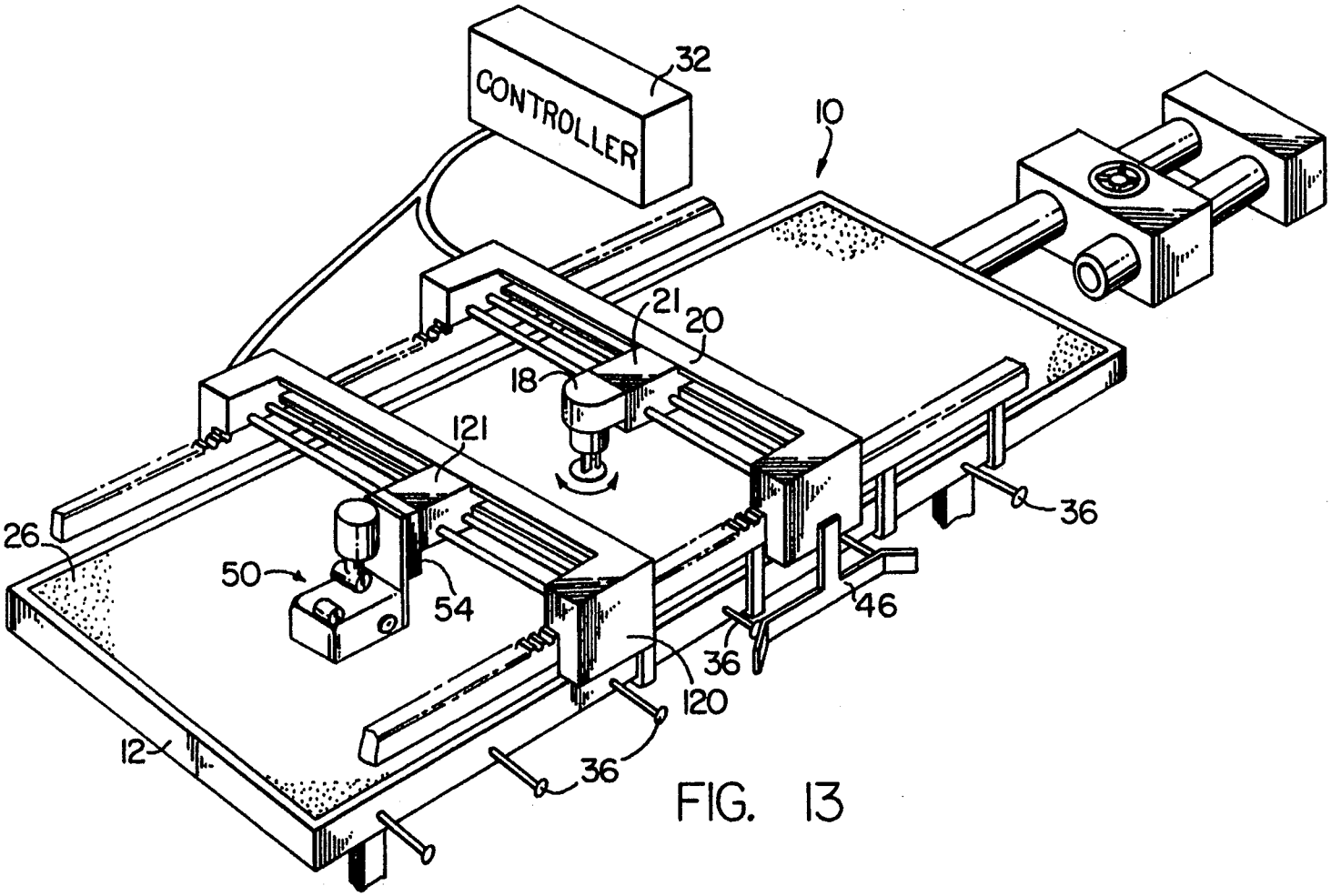
FIG. 13 is a view similar to FIG. 2 but showing the cleaner mounted on a carriage separate from the carriages associated with the cutting head of the cutting machine.

In FIG. 2 the cleaner 50 is shown attached to the cutter head carriage 21 in substitution for the cutter head. If desired the need for such substitution can be avoided by attaching the cleaner 50, or other cleaner embodying the invention, to a carriage system separate from that of the cutter head. Such an arrangement is shown in FIG. 13 wherein the cutting machine 22 in addition to the carriages 20 and 21 for the cutter head 18 includes a second set of similar carriages 120 and 121 for the cleaner 50. In this case the operation of the carriages 120 and 121 and of the cleaner 50 are controlled by the same main controller 32 which also controls the operation of the carriages 120 and 121 and of the cutting head 18. Preferably, the carriages 120 and 121 are disconnectable from the controller 32 and are removable from the table 12 to allow the carriages 120 and 121 and the cleaner 50 to be taken from the table 12 following cleaning of its bristle bed 26 and be placed on another table for cleaning of its bristle bed.

Figure 14:
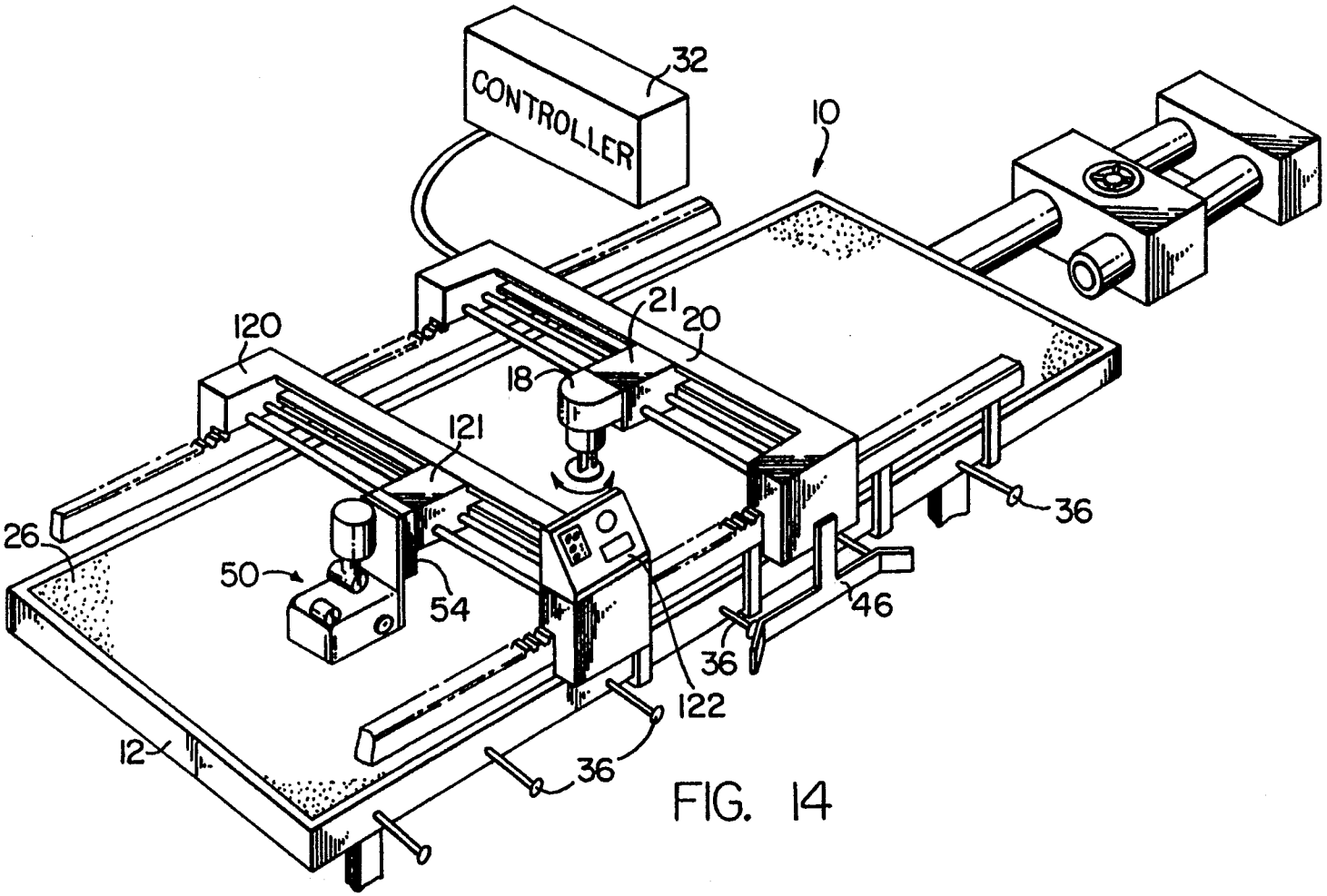
FIG. 14 is a view similar to FIG. 13 but showing the cutter and its associated carriages having a controller separate from the controller for the cutting head.
Figure 15:
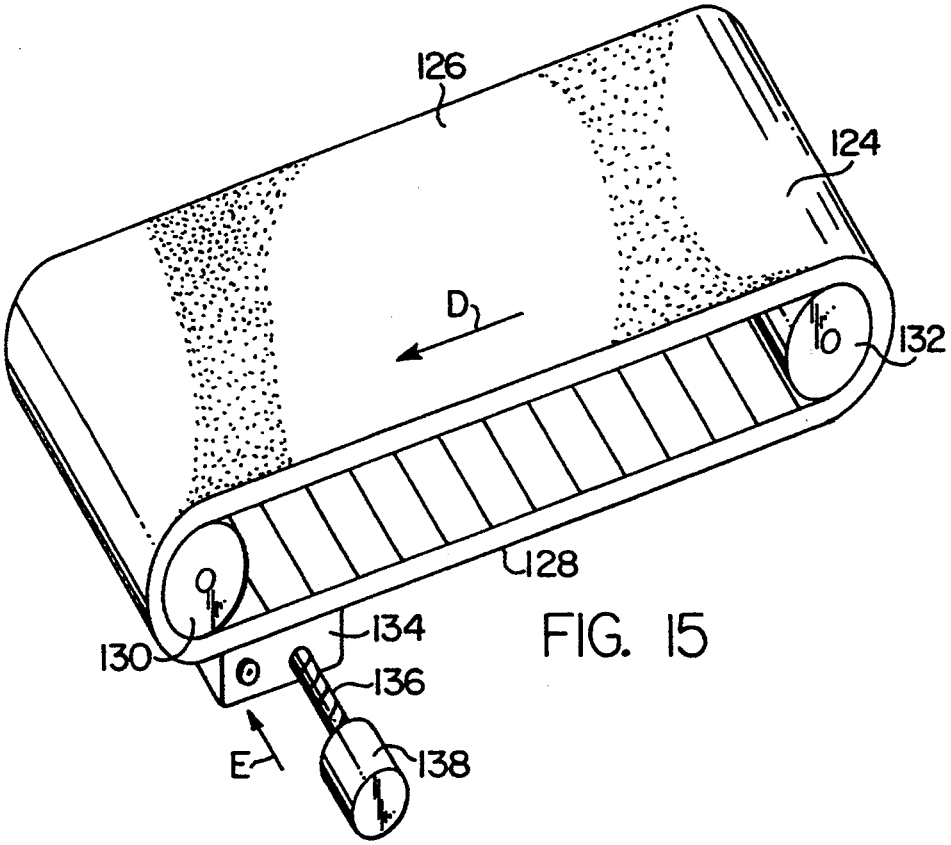
FIG. 15 is a perspective view of the endless conveyor member of a cutting machine having a conveyor type bed in combination with a cleaner for cleaning the bed and embodying the invention.

To further facilitate use of the carriages 120 and 121 and cleaner 50 of FIG. 13 with a number of different tables as shown in FIG. 14 the carriage and cleaner assembly comprised of the two carriages 120 and 121 and cleaner 50 may be provided with its own independent controller 122, mounted on the main carriage 120 to allow the cleaner 50 and its associated carriages 120 and 121 to operate entirely independently of the controller 32. In all of the embodiments so far described the cleaners have been shown in association with cutting machines having stationary beds. However, as shown for example by U.S. Pat. No. 4,452,113 and U.S. Pat. No. 4,730,526, some cutting machines may use conveyorized bristle beds which not only support the work material during a cutting process but are also useful in moving the work material to and from the cutting station. In the case of such a cutting machine with a conveyorized bristle bed a cleaner embodying the invention may use the normal movement of the bristle bed for providing the required relative movement between the bristle bed and the cleaning blades of the cleaner. Further, the conveyorized bristle beds are generally provided in the form of an endless member having upper and lower runs with the upper run providing the support surface for the work material. Where this is the case the cleaner of the invention may be advantageously associated with the lower run of the endless member so as to be in an out-of-the-way location. By way of example FIG. 15 shows such an arrangement wherein the bristle bed of a cutting machine is comprised of an endless member 124 which may be comprised of a succession of interconnected slats or links, as in the aforementioned patents, and having an upper run 126 and a lower run 128 by virtue of being trained around end sprockets 130 and 132. During advancement of the work material by the upper run 126 the endless member 124 is moved in the direction of the arrow D. In accordance with the invention a cleaner having blades extending into the bristles of the bristle bed provided by the endless member 124 is provided and arranged such that the normal movement of the endless member in the direction of the arrow D is used to provide the required relative movement between the bristle bed and the blades of the cleaner. In the illustrated case of FIG. 15 the cleaner 134 is located adjacent the bottom run 128 and is supported by the frame of the machine (not shown) so as to be immovable along the length dimension of the bristle bed. The cleaner may extend the full width of the bristle bed, but preferably and as shown in FIG. 15 it is a unit which similar to the cleaner 50 described above has a set of cleaning blades extending along a line a number of times smaller in length than the width of the bristle bed. Therefore, to allow for cleaning of the entire bristle bed the cleaner 134 must be movable along the width dimension of the bed. Such movement may be obtained in various different ways, but in the illustrated case a lead screw 136 is engagable with the cleaner 134 and driven by a motor 138 to move the cleaner 134 in the direction of the arrow E or parallel to the width dimension of the bed. The cleaner 134 may have either non-rotating or rotating cleaner blades as described above and may also include a vacuum pickup device for removing the dislodged debris and may also include a vibrating means for vibrating either the bristle bed in the vicinity of the blades or for vibrating the blades themselves. If desired, the cleaner 134 may also be made to be movable perpendicularly relative to the support surface of the bristle bed so as to be movable into and out of cleaning relationship relative to the bed. However, if desired, the cleaner may also be designed so as to be constantly in cleaning relationship relative to the bed so that some portion of the bed is cleaned whenever the endless member 128 is moved to advance work material relative to the cutting station. In keeping with this, the drive motor 138 for the lead screw 136 may also be operated in unison with the drive motor for the endless member 128 so that as the endless member 128 is moved in the direction of the arrow D the cleaner 134 is slowly moved in one direction or the other across the width dimension of the bristle bed so that as the endless member is periodically moved to advance work material the entire bristle bed provided by the endless member 128 is gradually cleaned.

I claim:

1. A sheet material cutting machine having a bristle bed with vertically extending bristles having free ends defining a support surface for supporting sheet material to be cut, and a cleaner means associated with said bristle bed for removing debris therefrom, said cleaner means having a plurality of blades fixed relative to and spaced from one another along a given line, support means for supporting said cleaner means on said cutting machine adjacent said bristle bed; and means for moving said blades of said cleaner means and said bed relative to one another so that each blade moves through said bed in a plane perpendicular to said given line to dislodge debris from said bristle bed, each of said blades having a free outer end and a length dimension extending from said given line to said free outer end, and each of said blades further having a thickness measured parallel to said given line which along most of its length is a number of times smaller than its width so that at said outer end it is relatively easily deflectable laterally out of said plane and is relatively non-deflectable in said plane.

2. The combination defined in claim 1 further characterized by said blades being mounted on a shaft extending along said given line, and means for rotating the shaft.

3. The combination defined in claim 2 further characterized by said cleaner means including a means engagable with said blades for stripping therefrom debris which tends to cling to said blades as they move free of said bristle bed.

4. The combination defined in claim 3 further characterized by said stripper means including at least one brush having bristles through which said blades move.

5. The combination defined in claim 1 further characterized by said support surface of said bristle bed being of generally rectangular shape with a width dimension and a length dimension, said given line extending parallel to said width dimension across the entire width of said support surface and said blades appearing along the entire length of said given line, said means for moving said blades and bed relative to one another being such that said relative movement occurs parallel to said length dimension of said supporting surface so that during said relative movement said blades clean said bristle bed across its entire width.

6. The combination defined in claim 1 further characterized by said support surface of said bristle bed being of generally rectangular shape with a width dimension and a length dimension, said given line having a length at least a number of times smaller than said width dimension, and said cleaner means including means for indexing said blades in the direction parallel to said given line, whereby said bristle bed may be cleaned over the entirety of said supporting surface by moving said blades and said bed relative to one another in a number of passes, said bed and said blades during each pass moving relative to one another along a direction perpendicular to said given line and with said blades at the end of each pass being indexed parallel to said given line to cause said blades to encounter a fresh portion of said bristle bed during the next pass.

7. The combination defined in claim 6 further characterized by said cleaner means including means permitting said given line along which said blades are located to be rotatable relative to said bed about an axis perpendicular to said support surface between a position at which said line extends parallel to the width dimension of said bed and a position at which said line extends parallel to the length dimension of said bed.

8. The combination defined in claim 6 further characterized by said cutting machine including a controller for controlling the movement of said blades relative to said bed so that said blades traverse successive passes along one or the other of said width and length dimensions of said support surface and at the end of each of said passes are indexed in the other of said directions so as to encounter a fresh section of said bed during the next pass.

9. The combination defined in claim 6 further characterized by said bristle bed being a stationary one, said cutting machine having a main carriage extending over said support surface parallel to said width dimension and movable relative to said bed along said length dimension, and a cutter head carriage movable along the length of said main carriage parallel to said width dimension, said support means and said means for moving said blades, of said cleaner means and said bed relative to one another including said main carriage and said cutter head carriage and said means for moving said bed and blades relative to one another including a means for mounting said cleaner to said cutting head carriage.

10. The combination defined in claim 1 further characterized by said bed being a stationary one, said support surface of said bed being rectangular in shape with a width dimension and a length dimension, said cutting machine including a main carriage extending over said support surface along said width dimension and being movable relative to said bed along said length dimension, and a cutter carriage mounted on said main carriage and movable along said main carriage parallel to said width dimension of said support surface, said support means and said means for moving said blades of said cleaner means and said bed relative to one another including one of said carriages and a means for mounting said cleaner means to said one carriage so that said cleaner means moves with said one carriage as that carriage is moved relative to said bed.

11. The combination defined in claim 1 further characterized by said cutting machine having a stationary frame and said bristle bed being a conveyor bed movable in one coordinate direction relative to said frame, said support means being said stationary frame and said means for moving said bed and blades relative to one another being a means mounting said cleaner means to said stationary frame so that said blades and bed move relative to one another when said bed is moved relative to said frame.

12. The combination defined in claim 11 further characterized by said conveyor bed being in the form of an endless member having an upper run and a lower run, said upper run defining said support surface, and said cleaner means being mounted to said cutting machine frame so as to be located adjacent said lower run of said endless member.

13. The combination defined in claim 12 further characterized by said given line having a length at least a number of times smaller than the width of said bristle bed, and said support means including means for progressively moving said cleaner along said width dimension in unison with the movement of said conveyor bed.

14. The combination defined in claim 1 further characterized by said bed being a stationary one with said support surface having a length dimension and a width dimension, said cutting machine having a main carriage extending across said support surface parallel to said width dimension and movable along said length dimension, and a cutter head carriage movable on said main carriage parallel to said width dimension, and said support means being a cleaner carriage separate from said main carriage extending across said support surface parallel to said width dimension and movable along said length dimension, said means for moving said blades of said cleaner means and said bed relative to one another including means connecting said cleaner means to said cleaner carriage so that said cleaner means is carried by said cleaner carriage.

15. The combination defined in claim 14 further characterized by said cutting machine including a main controller for controlling its operation in cutting sheet material supported by said support surface, and means connecting said cleaner carriage and said cleaner means with said main controller for control of their operations by said main controller.

16. The combination defined in claim 14 further characterized by said cutting machine including a main controller for controlling the operation of said cutting machine in the cutting of sheet material supported by said support surface, and said cleaner means including a separate controller associated with said cleaner carriage and said cleaner means for controlling the operation of said cleaner carriage and cleaner.

17. The combination defined in claim 16 further characterized by said cleaner controller being carried by said cleaner carriage.

18. The combination defined in claim 14 further characterized by said cleaner carriage being removable from said cutting machine and following said removal being usable with another cutting machine.

19. The combination defined in claim 1 further characterized by said cleaner means including a vacuum device having a mouth located near the free ends of said bristles of said bristle bed for creating a vacuum in the vicinity of said cleaner blades so as to receive and carry away debris dislodged by said blades.

20. The combination defined in claim 19 further characterized by said cutting machine means for passing pressurized air through said bristles of said bristle beds in the direction toward said free ends of said bristles to assist in moving debris to the mouth of said vacuum device.

21. The combination defined in claim 19 further characterized by said cleaner means including means for vibrating said bristle bed in the vicinity of said cleaner blades.

22. The combination defined in claim 19 further characterized by said support means being a stationary frame of said cutting machine, and said cleaner means including means for vibrating said cleaner blades relative to said stationary frame.

23. The combination defined in claim 1 further characterized by said cleaner means including means for vibrating said bristle bed in the vicinity of said cleaner blades.

24. The combination defined in claim 1 further characterized by said support means being a stationary frame of said cutting machine, and said cleaner means including means for vibrating said cleaner blades relative to said stationary frame.

25. A cleaner having means for cleaning the work supporting bristle bed of a sheet material cutting machine having a bristle bed defined by a plurality of generally vertically extending bristles with free ends defining a support surface having two coordinate direction for supporting the sheet material to be cut, said cutting machine including a frame, a main carriage extending over said support surface in one coordinate direction of said support surface and a cutter head carriage movable on said main carriage in the other coordinate direction of said support surface, said means for cleaning the work supporting bristle bed of a sheet material cutting machine comprising a plurality of blades fixed relative to and spaced from one another along a given line, and attaching means forming part of said cleaner for attaching said cleaner to one of said carriages of said cutting machine so that said blades move through the bristle bed of said cutting machine as said one carriage is moved in one of said coordinate directions relative to said supporting surface, each of said blades being located essentially in an associated plane perpendicular to said support surface and to said given line and having a free outer end each of said blades in said plane having a length dimension extending from said given line to said free outer end and at each point along said length dimension having an associated width dimension generally perpendicular to said length dimension, and each of said blades further having a thickness measured parallel to said given line which along most of said length dimension of said blade is a number of times smaller than said associated width dimension so that at said outer end it is relatively easily deflectable laterally out of said plane and is relatively non-detectable in said plane.

26. A cleaner as defined in claim 25 further characterized by said blades being fixed to a shaft rotatable about said given line, and means for rotating said shaft.

27. A cleaner as defined in claim 26 further characterized by said means for cleaning the work supporting bristle bed including a means engagable with said blades for stripping therefrom debris which tends to cling to said blades as they move free of said bristle bed when said cleaner is attached to a cutting machine by said attaching means.

28. A cleaner as defined in claim 27 further characterized by said stripper means including at least one brush having bristles through which said blades move.

29. A cleaner as defined in claim 25 further characterized by said means for cleaning the work supporting bristle bed including a vacuum device having a mouth adapted to be located adjacent the free ends of said bristles when said cleaner is attached to a cutting machine by said attaching means and creating a vacuum in the vicinity of said blades so as to receive and carry away debris dislodged from said bristle bed by said blades.

30. A cleaner as defined in claim 29 further characterized by said means for cleaning the work supporting bristle bed including means for vibrating said bed in the vicinity of said blades when said cleaner is attached to cutting machine by said attaching means.

31. A cleaner as defined in claim 29 further characterized by said means for cleaning the work supporting bristle bed including means for vibrating said cleaner blades relative to said cutting machine frame when said cleaner is attached to a cutting machine by said attaching means.

32. A cleaner having means for cleaning the work supporting bristle bed of a sheet material cutting machine having a bristle bed defined by a plurality of generally vertically extending bristles with ends defining a support surface having two coordinate directions for supporting the sheet material to be cut, said cutting machine including a frame, a main carriage extending over said support surface in one coordinate direction of said support surface and a cutter head carriage movable on said main carriage in the other coordinate direction of said support surface, said means for cleaning the work supporting bristle bed comprising a plurality of blades fixed relative to and spaced from one another along a given line, a cleaner carriage, and connecting means for connecting said cleaner carriage to said cutting machine separately from said main carriage so as to extend across said support surface along said one coordinate direction of said support surface and to be movable relative to said support surface in the other coordinate direction of said support surface, said means for cleaning the work supporting bristle bed being carried by said cleaner carriage so that each of its blades moves through said bristle bed in a plane perpendicular to said line as the cleaner carriage is moved in said other coordinate direction relative to the bed, each of said blades having a free outer end and a length dimension extending from said given line to said free outer end, and each of said blades further having a thickness measured parallel to said given line which along most of its length is a number of times smaller than its width so that at said outer end it is relatively easily deflectable laterally out of said plane and is relatively non-deflectable in said plane.

33. A cleaner as defined in claim 32 further characterized by said blades being fixed to a shaft rotatable about said given line, and said means for cleaning the work supporting bristle bed including means for rotating said shaft.

34. A cleaner as defined in claim 33 further characterized by said means for cleaning the work supporting bristle bed including a means engagable with said blades for stripping therefrom debris which tends to cling to said blades as they move free of said bristle bed when said cleaner carriage is connected to said cutting machine by said connecting means.

35. A cleaner as defined in claim 34 further characterized by said stripper means including at least one brush having bristles through which said blades move.

36. A cleaner as defined in claim 32 further characterized by said cleaner carriage being removable from the cutting machine and after being so removed being usable with another cutting machine.

37. A cleaner as defined in claim 32 further characterized by a controller associated with said cleaner carriage and said means for cleaning the work supporting bristle bed for controlling the operation of said cleaner carriage and said means for cleaning the work supporting bristle bed during the cleaning of a bristle bed.

38. A cleaner as defined in claim 37 further characterized by said controller being carried by said cleaner carriage.

39. A cleaner as defined in claim 32 further characterized by said means for cleaning the work supporting bristle bed including a vacuum device having a vacuum mouth located near the free ends of the bristles of said bristle bed when said cleaner carriage is connected to said cutting machine by said connecting means and creating a vacuum in the vicinity of said blades so as to receive and carry away debris dislodged by said blades.

40. A cleaner as defined in claim 39 further characterized by said means for cleaning the work supporting bristle bed including a means for vibrating in the vicinity of said blades said bristle bed when said cleaner carriage is connected to said cutting machine by said connecting means.

41. A cleaner as defined in claim 39 further characterized by said means for cleaning the work supporting bristle bed including means for vibrating said blades relative to the frame of said cutting machine when said cleaner carriage is connected to said cutting machine by said connecting means.

42. A cleaner having means for cleaning the work supporting bristle bed of a conveyor bed cutting machine wherein the bristle bed is in the form of an endless member having upper and lower runs with the upper run having generally vertically extending bristles the upper ends of which are free and define a support surface having two coordinate directions for supporting the work material to be cut, said cutting machine having a stationary frame relative to which said endless member moves in one of said coordinate directions, said means for cleaning the work supporting bristle bed comprising a plurality of blades fixed relative to and spaced from one another along a given line, and mounting means for mounting said means for cleaning the work supporting bristle bed to said frame of the cutting machine with said line extending parallel to the other of said coordinate directions so that each of said blades moves through said bristle bed in a plane perpendicular to said line as said endless member is moved relative to said frame in said one coordinate direction, each of said blades having a free outer end and a length dimension extending from said given line to said free outer end, and each of said blades further having a thickness measured parallel to said given line which along most of its length is a number of times smaller than its width so that at said outer end it is relatively easily deflectable laterally out of said plane and is relatively non-deflectable in said plane.

43. A cleaner as defined in claim 42 further characterized by said blades being fixed to a shaft rotatable about said given line, and means for rotating said shaft.

44. A cleaner as defined in claim 43 further characterized by said means for cleaning the work supporting bristle bed including a vacuum device having a mouth creating a vacuum in the vicinity of said blades so as to receive and carry away debris dislodged from the associated bristle bed by said blades.

45. A cleaner as defined in claim 44 further characterized by said means for cleaning the work supporting bristle bed including means for vibrating said bed when said cleaner is mounted to said frame by said mounting means.

46. A cleaner as defined in claim 44 further characterized by said means for cleaning the work supporting bristle bed including means for vibrating said blades relative to said frame when said cleaner is mounted to said frame by said mounting means.

47. A cleaner as defined in claim 43 further characterized by said means for cleaning the work supporting bristle bed including a means engagable with said blades for stripping therefrom debris which tends to cling to said blades as they move free of said bristle bed when said cleaner is mounted to said frame by said mounting means.

48. A cleaner as defined in claim 47 further characterized by said stripper means including at least one brush having bristles through which said blades move.

* * * * *